US010052775B2

(12) United States Patent
Davos et al.

(10) Patent No.: US 10,052,775 B2
(45) Date of Patent: Aug. 21, 2018

(54) METHOD AND SYSTEM FOR THE MANUFACTURE OF A RAZOR CARTRIDGE

(71) Applicant: BIC Violex SA, Agiou Athanasiou (GR)

(72) Inventors: Vasileios Davos, Ilion (GR); Georgios Koulourias, Marousi (GR); Petros Polychronidis, Nea Erythrea (GR)

(73) Assignee: BIC VIOLEX S.A., Anixi (GR)

( * ) Notice: Subject to any disclaimer, the term of this patent is extended or adjusted under 35 U.S.C. 154(b) by 6 days.

(21) Appl. No.: 14/430,330

(22) PCT Filed: Sep. 26, 2012

(86) PCT No.: PCT/EP2012/068956

§ 371 (c)(1),
(2) Date: Mar. 23, 2015

(87) PCT Pub. No.: WO2014/048460

PCT Pub. Date: Apr. 3, 2014

(65) Prior Publication Data

US 2015/0239137 A1 Aug. 27, 2015

(51) Int. Cl.
*B26B 21/40* (2006.01)
*B26B 21/52* (2006.01)

(52) U.S. Cl.
CPC ..... *B26B 21/4068* (2013.01); *B26B 21/528* (2013.01); *Y10T 29/4987* (2015.01); *Y10T 29/49822* (2015.01); *Y10T 29/53991* (2015.01)

(58) Field of Classification Search
CPC ..... B26B 21/4068; B26B 21/528; Y10T 29/49822; Y10T 29/4987; Y10T 29/53991; Y10T 29/53383; Y10T 29/53387; Y10T 29/53391
See application file for complete search history.

(56) References Cited

U.S. PATENT DOCUMENTS

| | | | |
|---|---|---|---|
| 3,832,432 | A | 8/1974 | Perry |
| 3,973,313 | A | 8/1976 | Hunter |
| 4,166,527 | A | 9/1979 | Beezer |

(Continued)

FOREIGN PATENT DOCUMENTS

| | | |
|---|---|---|
| EP | 0 682 572 | 4/2002 |
| WO | WO 99/16591 | 4/1999 |

(Continued)

OTHER PUBLICATIONS

International Report of PCT/EP2012/068956; dated Jun. 4, 2013.
European Office Action, dated Mar. 26, 2018 for European Application No. 12 768 772.1-1006.

*Primary Examiner* — Sarang Afzali
*Assistant Examiner* — Darrell C Ford
(74) *Attorney, Agent, or Firm* — Polsinelli PC

(57) ABSTRACT

A molded plastic housing is provided with elastic support members extending in a hollow space, and elastically supporting members. These members have an elongated edge running from a first to a second lateral face of the housing, and accessible through a window. A pre-clamp is assembled to the housing, by placing leg portions on either side of the hollow space, with a base portion extending across the edge of the member. The leg portions are deformed to cooperate with the bottom face of the housing to hold the member in the housing.

10 Claims, 7 Drawing Sheets

(56) References Cited

U.S. PATENT DOCUMENTS 4,172,514 A 10/1979 Shantz et al.
4,223,781 A 9/1980 Beezer
4,270,268 A * 6/1981 Jacobson ..... B26B 21/227 30/47
4,378,633 A * 4/1983 Jacobson ..... B26B 21/227 30/47
4,378,634 A * 4/1983 Jacobson ..... B26B 21/4018 30/47
4,488,357 A * 12/1984 Jacobson ..... B26B 21/225 30/527
4,492,024 A * 1/1985 Jacobson ..... B26B 21/225 30/50
4,530,433 A 7/1985 Cucchetto
4,573,266 A * 3/1986 Jacobson ..... B26B 21/227 30/41
4,614,019 A 9/1986 Shimizu et al.
4,932,122 A * 6/1990 Shurland ..... B26B 21/222 30/346.5
5,224,267 A * 7/1993 Simms ..... B26B 21/4068 30/50
5,318,429 A * 6/1994 Butlin ..... B26B 21/06 425/116
5,369,885 A * 12/1994 Ferraro ..... B26B 21/227 30/41
5,416,974 A * 5/1995 Wain ..... B26B 21/227 30/50
5,481,802 A * 1/1996 Lembke ..... B26B 21/06 30/346.57
5,761,814 A * 6/1998 Anderson ..... B26B 21/227 30/50
5,813,293 A * 9/1998 Apprille, Jr. ..... B26B 21/225 30/47
6,009,624 A * 1/2000 Apprille, Jr. ..... B26B 21/227 30/48
6,035,537 A * 3/2000 Apprille, Jr. ..... B26B 21/227 30/346.5
6,409,438 B1 6/2002 Kohler
6,758,320 B1 7/2004 Tegel
7,185,753 B2 3/2007 Hartness et al.
7,197,825 B2 * 4/2007 Walker ..... B26B 21/225 30/34.2
7,207,434 B2 4/2007 Hartness et al.
7,272,991 B2 * 9/2007 Aviza ..... B26B 21/4068 30/50
7,607,230 B2 * 10/2009 Aviza ..... B26B 21/4068 30/50
7,765,700 B2 * 8/2010 Aviza ..... B26B 21/4068 30/50
8,117,725 B2 2/2012 Pesikov
9,475,201 B2 * 10/2016 Georgakis ..... B26B 21/222
2005/0172494 A1 * 8/2005 Aviza ..... B26B 21/4068 30/50
2009/0077809 A1 * 3/2009 Lee ..... B26B 21/222 30/34.2
2010/0299928 A1 * 12/2010 Clarke ..... B26B 21/4018 30/34.1
2011/0203120 A1 * 8/2011 Witkus ..... B26B 21/222 30/346.58
2011/0308089 A1 * 12/2011 Bridges ..... B26B 21/222 30/77
2011/0313559 A1 12/2011 Aviza et al.
2012/0030948 A1 * 2/2012 Walker, Jr. ..... B26B 21/4018 30/50
2012/0151775 A1 6/2012 Ren
2014/0000114 A1 * 1/2014 Wester ..... B26B 21/4012 30/32
2015/0082638 A1 * 3/2015 Georgakis ..... B26B 21/222 30/77
2015/0090085 A1 * 4/2015 Griffin ..... B26B 21/4018 83/13
2015/0239137 A1 * 8/2015 Davos ..... B26B 21/4068 29/426.5
2016/0297086 A1 * 10/2016 Efthimiadis ..... B26B 21/4068
2017/0028577 A1 * 2/2017 Ntavos ..... B26B 21/4012

FOREIGN PATENT DOCUMENTS

WO WO 2005/090015 9/2005
WO 2010/006654 A1 1/2010
WO WO 2011/075505 6/2011
WO WO 2012/005884 1/2012

* cited by examiner

METHOD AND SYSTEM FOR THE MANUFACTURE OF A RAZOR CARTRIDGE

This application is a national stage application of International Application No. PCT/EP2012/068956, filed on Sep. 26, 2012, the entire contents of which are incorporated herein by reference.

The embodiments of the present invention relate to a method and system for the manufacture of a razor cartridge.

BACKGROUND OF THE INVENTION

Field of Invention

Mechanical razor heads with movable blades have been described in the past. In such heads, a cutting member is positioned on spring tongues which push it upwards, in contact with a part of the head which defines an upper stop. The position of the blade is to be defined very precisely, since its exposure will greatly affect the shaving performance of the razor head.

It is a challenge to manufacture such products in a very reliable way, yet cost effectively and with high throughput.

WO 2010/006654 discloses a suitable way, by which the cutting members are placed into a guard. A plastic cap covers the guard and cutting members and is assembled to the guard by ultra-sonic welding.

Although this process is very useful when the razor head comprises two plastic parts, which can be each tailored to a specific function, one may alternatively want to reduce the number of different plastic parts (ie reduce the number of molds and the risk of discarding an assembly because only one of the two plastic parts is outside of the acceptable dispersion range).

SUMMARY OF THE INVENTION

To this aim, it is provided a method for the manufacture of assemblies, which includes:

providing a sub-assembly comprising:

a molded plastic housing having a front part and a rear part, a first lateral part and a second lateral part, the front, rear, first and second lateral parts defining a hollow space between them, the housing having a top face having a window mouthing into the hollow space, and an opposed bottom face, the housing further comprising elastic support members extending in the hollow space, at least one member elastically supported by at least one elastic support member, and having an elongated edge running from the first to the second lateral faces, and accessible through the window, providing a pre-clamp, made of a formable material, and having a U-shape with a first and a second parallel leg portions joined by a transverse base portion, assembling the pre-clamp to the sub-assembly, by placing the first and second leg portions on either sides of the hollow space with the base portion extending across the edge of the member, deforming the first and second leg portions to cooperate with the bottom face of the housing to hold the member in the housing.

The above method showed able to provide the required levels of accuracy and throughput.

In the embodiments of the present invention, one might also use one or more of the features defined in the claims.

BRIEF DESCRIPTION OF THE DRAWINGS

Other characteristics and advantages of the present invention will readily appear from the following description of one of its embodiments, provided as a non-limitative examples, and of the accompanying drawings.

On the drawings.

On the different Figures, the same reference signs designate like or similar elements.

DETAILED DESCRIPTION OF THE INVENTION

Figure 2:
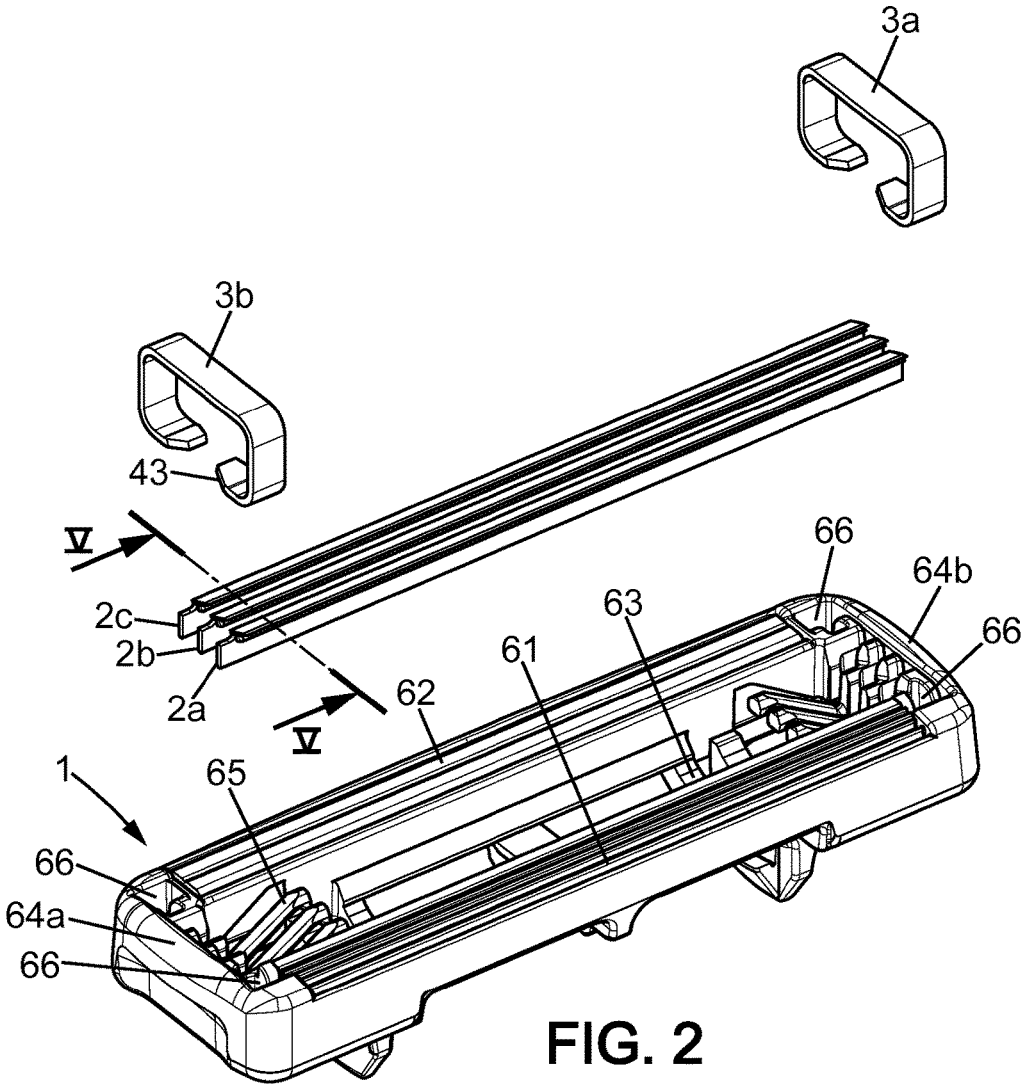
FIG. 2 is an exploded perspective view of a razor head assemblable by the system of FIG. 1.

FIG. 2 shows an exploded view of an example of a razor head suitably assemblable by the following process. As shown on FIG. 2, according to this example, the razor head is of the type having a guard 1, three cutting members 2*a*, 2*b*, 2*c* movably (translatably) mounted in the guard under spring action, two lateral clamps 3*a*, 3*b* that cooperate with the bottom face of the housing and retain the cutting members from falling off the guard through the top window. The clamps provide an upper abutment zone for the lateral sides of the cutting members.

In particular, the guard comprises a front area 61 and a rear area 62 (front and rear are defined by the normal direction of shaving). The front area 61 may comprises a guard bar, and the rear area may comprise a lubrication strip. Between the front and rear areas, a central area 63 defines a hollow space receiving one or more cutting member(s) extending in parallel to one another. The cutting members extend between two lateral areas 64*a* and 64*b* of the guard. The two lateral areas 64*a* and 64*b* extend from the front area 61 to the rear area 62.

The guard 1 is also provided with biasing members 65. These biasing members bias the cutting members toward a rest position. As an exemplary description, biasing members 65 comprise spring tongues. A spring tongue extends from a lateral area toward the center of the guard, sensibly in parallel with the cutting member edge. It also extends from the bottom area toward the top area of the guard, where 'top' designates the face normally used for shaving, and 'bottom' an opposite face, through which rinsing water and cut hair flow. The cutting member rests on two opposed spring tongues.

Each lateral portion of the guard is provided with two insertion holes 66. Such holes are through holes which extend from the top to the bottom area of the guard. For each given lateral portion, an insertion hole is provided on either side of the hollow space.

Figure 5:
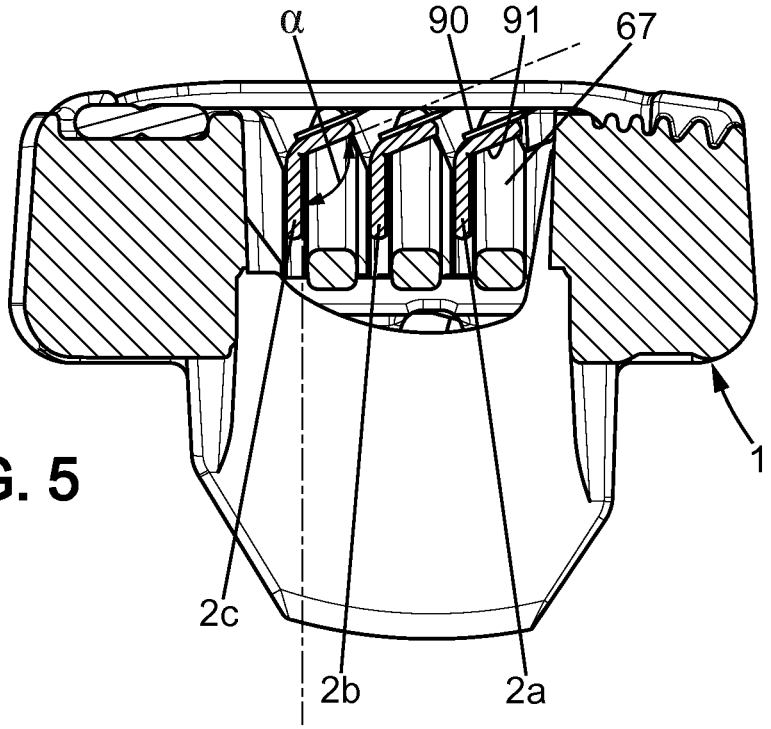
FIG. 5 is a sectional lateral view of a guard with assembled cutting members along line V-V on FIG. 2, before assembly of the clamps.

The cutting members can for example be of the type 'blade fixed to a bent support'. FIG. 5 shows an example. In such examples, a straight blade 90 made of a specific material, and having a sharpened edge, is fixed (for example welded) to a support 91 (which can be made of a specific, but different, material too) which is bent by an angle α of for example between 90° and 135° between its two portions. The edge of the blade is sharpened and coated by a strengthening coating and a lubrication coating.

Figure 1:
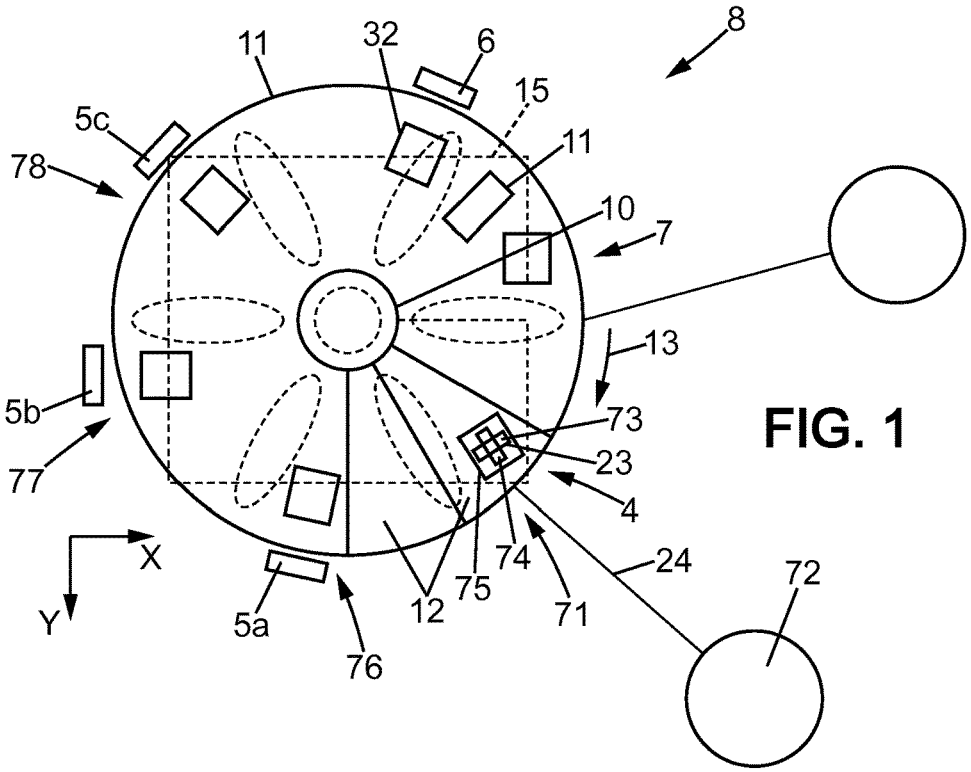
FIG. 1 is a schematic top view of a system usable to manufacture razor heads.

FIG. 1 schematically shows an example of a machine which assembles such a razor head.

The inputs of the machine are a guard feeding station 4, three cutting member magazines 5*a*, 5*b*, 5*c*, and a pre-clamp feeding station 6. The number of cutting member magazines may vary, for example from 1 to 5.

The machine 8 comprises a servo-motor 10 which drives stepwise a platen 11 consisting of a plurality of stages 12 (only two stages are shown on FIG. 1, but such stages are provided across the whole platen) along an assembly path 13 (rotation about the vertical Z axis hereafter).

The cycle is made of ⅓ platen movement and ⅔ platen stay. During platen stay, other tools provided along the assembly path 13 are operated under the action of a crankshaft 15 synchronized with the servo-motor 10.

The stages of the platen can be loosely connected to one another, floating in the room's reference frame.

Figure 3:
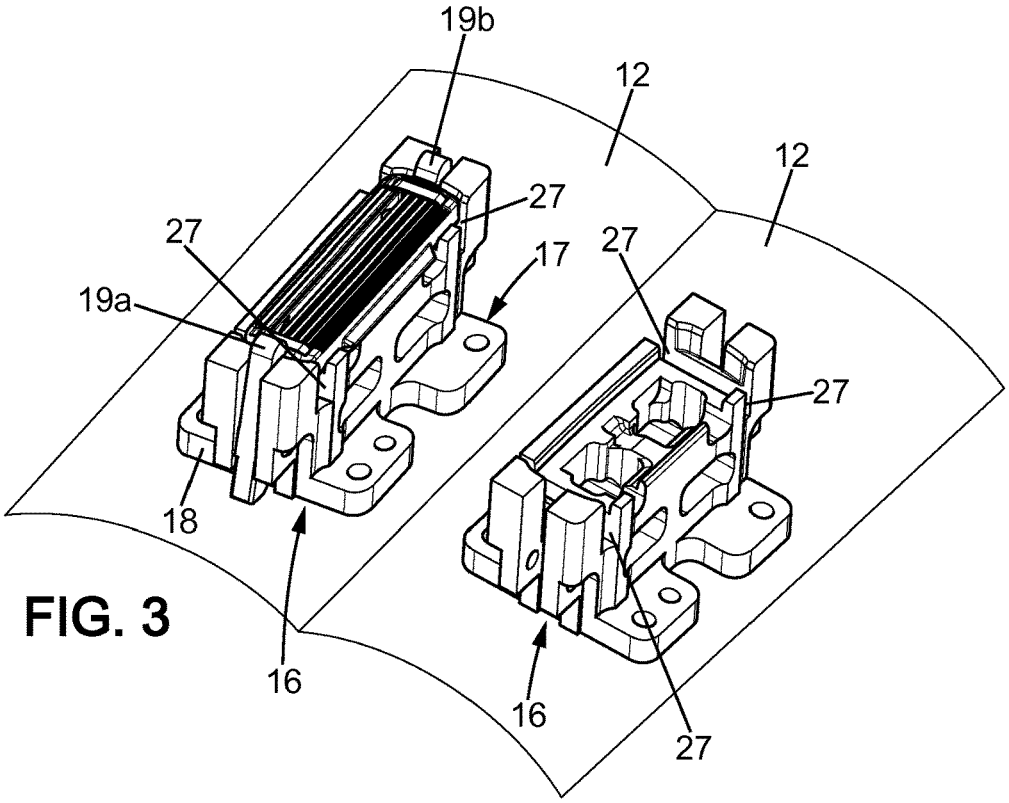
FIG. 3 is a perspective partial view of an assembly path.

As shown on FIG. 3, each stage 12 of the platen receives a nest 16 which is fixed to the stage 12.

The nest comprises a base 17 which has a bottom portion 18 fixed to the stage (through screws), and a receiving cavity (filled with an assembled razor head on one of the nests of the above drawing) shaped to receive the guard. Lateral jaws 19*a*, 19*b* are movably mounted on the base, and are spring-loaded with respect thereto in order to hold the guard 1 in the nest.

Figure 9:
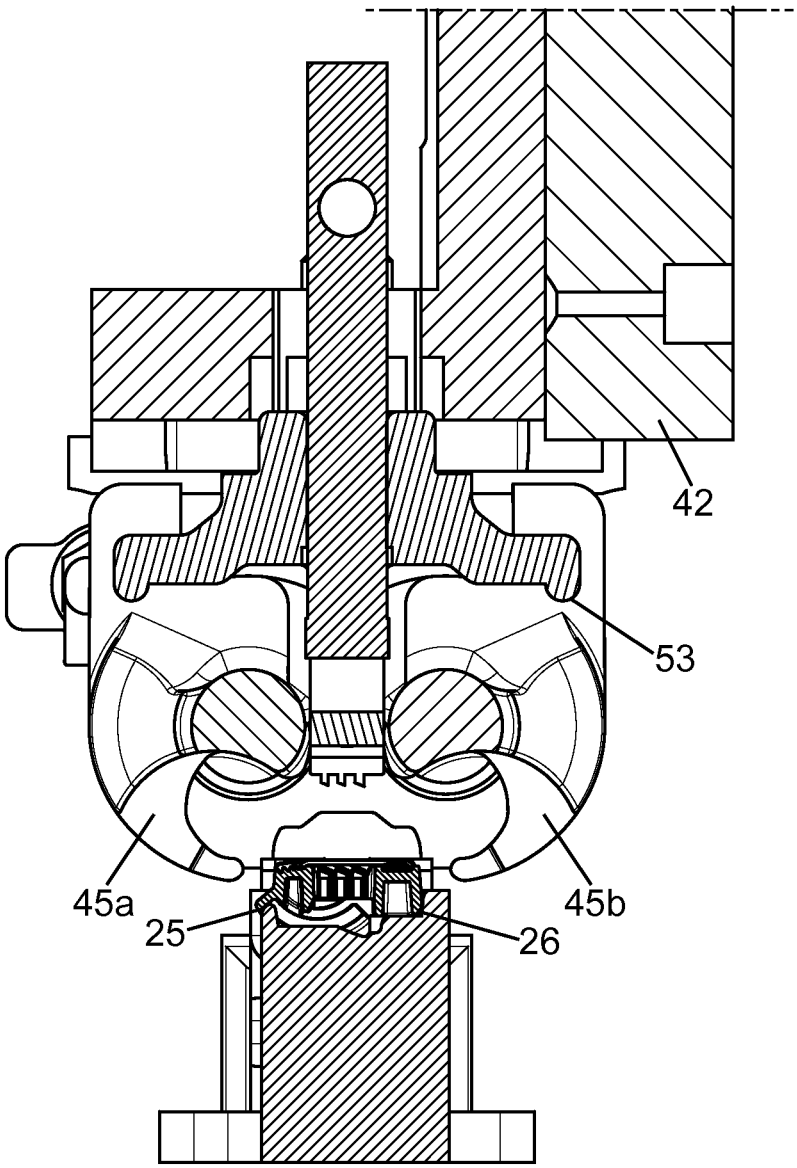
Figure 10:
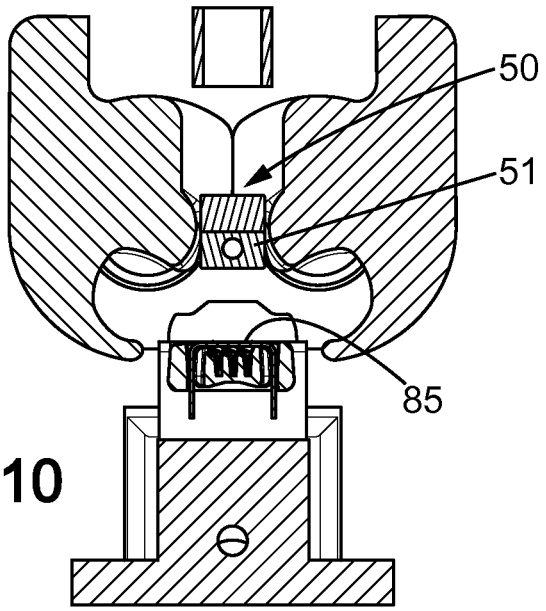

In particular, in FIG. 9 (which shows the nest holding the guard in the clamp-forming station), it is shown that the guard is borne on the nest in its central part (front and rear bottom extensions of the guard supported by the nest). FIG. 10, which shows a parallel section through the nest in the plane of the claws, shows that the bottom of the guard is accessible through the nest there. As shown in FIG. 3, the nest is provided with insertion holes at the location of each clamp end, to receive ends of bending claws.

Back to FIG. 1, a first station 71 is a guard placing station 71. Guards 1 are provided oriented from a vibratory bowler 72 (movement ensured through air jets). A pick-and-place apparatus 23 is used to pick the guard from the delivery line 24 and place it in the cavity of the nest. The delivery line 24 is designed to provide razor guards from the bowler 72 along the correct orientation.

The pick-and-place apparatus 23 can use an end provided with suction (vacuum) to hold the guard and release it in correct position in the nest 16.

Movement of the end can be commanded by the crankshaft 15. Hence, the end is moved in Z direction (up-down) with a vertically mobile part 73, which itself is mounted on a horizontally mobile part 74 which moves in the horizontal plane with respect to a fixed frame 75 of the system. Alternatively, movement of the end can be commanded by a servo-motor synchronized with the servo-motor 10.

The guard is moved to a first cutting member-placing station 76. Here, 3 cutting member-placing stations 76, 77, 78 are used, the one after the other along the assembly path. All cutting member-placing stations are identical.

Figure 4:
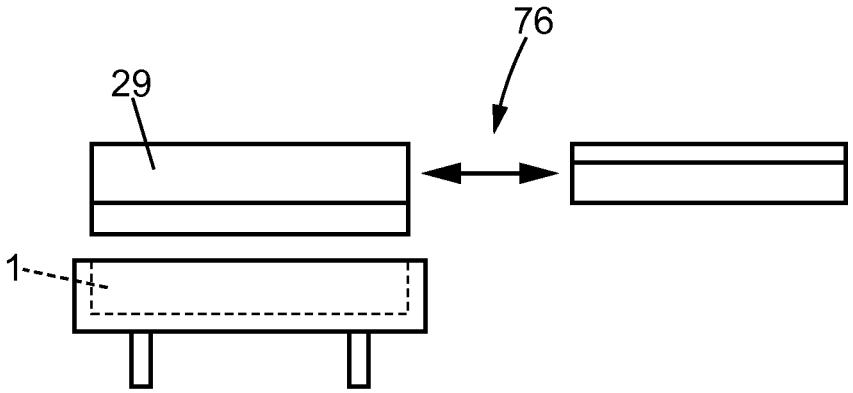
FIG. 4 is a schematic view of a blade placement station.

As shown schematically on FIG. 4, the station comprises an end 29 which is used to grasp the cutting member using vacuum and deliver it to the guard 1. This part is adapted to fit to the tiny cutting member geometry needed here. The cutting member is delivered through a window of the top face in the internal space. This end 29 is subject to movement along the Z direction and in the horizontal plane as well. A similar command arrangement as for the guard-placing station can be used here. A difference is the Z-stroke which may be smaller, since the cutting member has a smaller Z-extension than the guard.

FIG. 5 schematically shows a cross-sectional view through the assembled product at this stage, showing the guard carrying three cutting members.

At this stage, all three cutting members 2*a*, 2*b*, 2*c* are placed in the guard 1, to provide a sub-assembly, as shown on FIG. 5. Each cutting member rests on two spring tongues 67 (one spring tongue on each lateral side of the guard). The natural elasticity of the spring tongues defines the rest position of the cutting member during assembly.

Control can be provided after the blades are placed in the guard. Control can be performed by pressure switch during each pick-and-place action. If the control does not reveal any problem, the process continues as follows. If the control reveals a problem, the process continues as follows except that the pre-clamps are not delivered (meaning that the following tools will operate 'empty' in such case), or the process continues as follows but the head will be discarded after clamp formation.

The guard with introduced cutting members is moved into the clamp delivery station 32. It is possible to retain the cutting members inside the head by any additional means. There can be two clamp-providing stations, one for each pre-clamp to be placed on each respective side of the guard. The stations are similar, except for the different locations for providing the pre-clamp (one on each lateral side of the guard). A device similar to the one handling the cutting members can be used.

Figure 6:
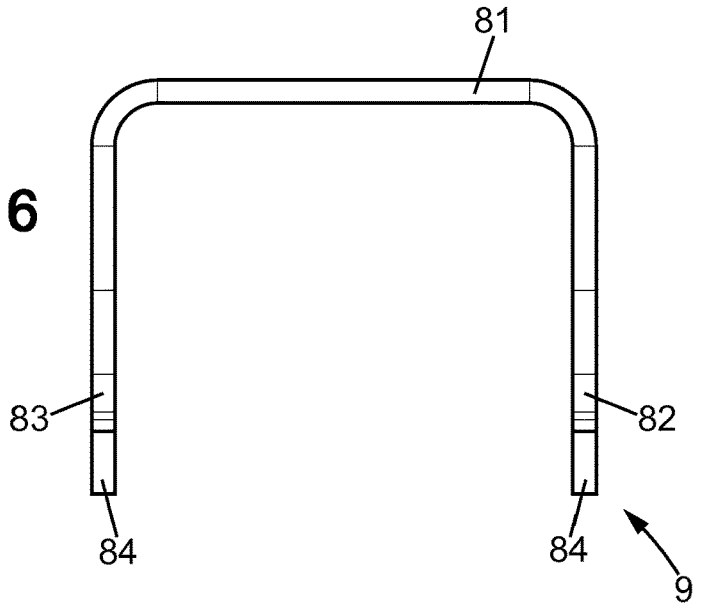
FIG. 6 is a schematic lateral view of a pre-clamp usable in the system of FIG. 1.

FIG. 6 schematically shows the pre-clamp in cross-section as it is provided from the pre-clamp feed station 6. The pre-clamp 9 is sensibly U-shaped, with a base 81 and two aisles (or leg portions) 82, 83. It is made of a formable material, for example a thin sheet of suitable metal. In the present example, the two aisles 82, 83 are identical. Each aisle extends to an end 84. Each end portion can be tapered (sensibly V-shaped in section transverse to the section of FIG. 6).

FIG. 10 schematically shows how the U-shaped pre-clamp 9 is placed in the guard, with the base 81 of the pre-clamp covering the blade lateral sides, and the aisles 82-83 of the pre-clamp inserted in respective insertion holes 66 of the guards in front of and after the blades (see FIG. 2). One such pre-clamp is inserted on each lateral side of the guard, through a front and a rear insertion holes.

Figure 7:
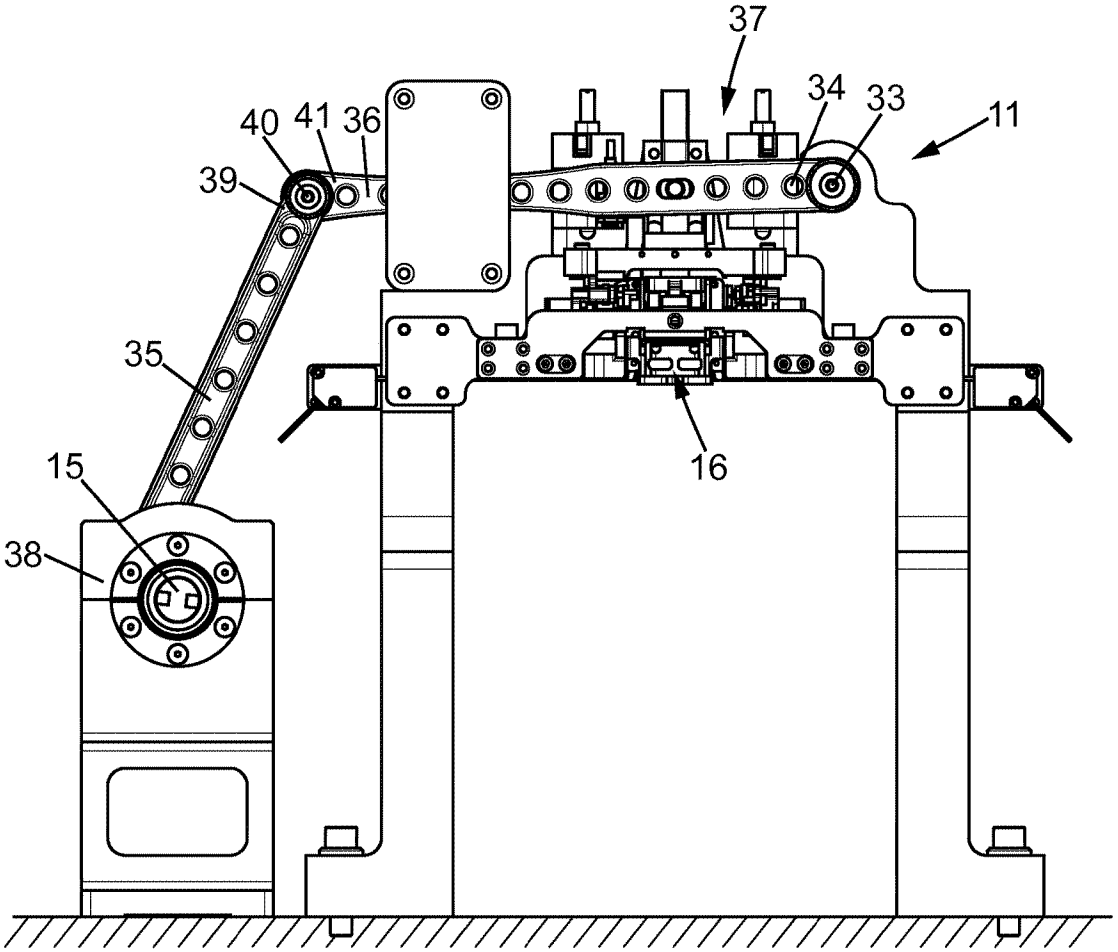
FIG. 7 is a schematic front overall view of a clamping station of the assembly system of FIG. 1.

FIG. 7 is an overview of the clamp-forming station 11. An articulated arm system comprises a first arm 35 mounted at one end 38 to the crankshaft 15, and a second end 39 mounted at an hinge 40 to the first end 41 of a second arm 36. The second arm 36 has its second end 34 rotatably mounted to a fixed base 33. The second arm 36 is connected to a carriage 37 of the forming tool, in order to cause a back-and-forth translative vertical movement thereof, enabling to shape the U-bent pre-clamp in a precise location in the head.

In the clamp-forming station 11, both ends of both U-shaped pre-clamps are bent simultaneously to their final shape.

Figure 8:
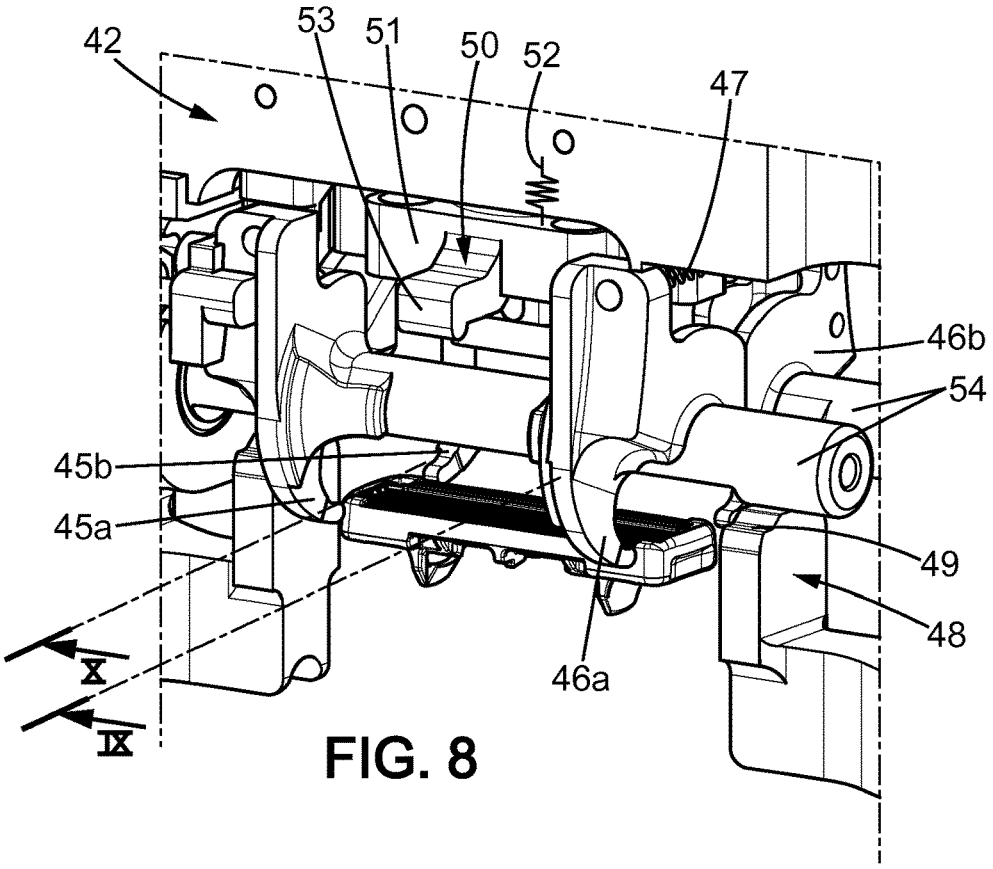
FIG. 8 is a perspective enlarged view of the station of FIG. 7, FIGS. 9 and 10 are partial sectional views respectively through lines IX-IX and X-X of FIG. 8, at a first step of the clamping process.

As shown on FIG. 8, a cam bracket 48 holds the nest which receives the head (the nest is not shown on FIG. 8, but the head is shown which is held therein). The cam bracket 48 is provided with a caming surface 49.

The forming station comprises a base 42 which is movable up and down under crankshaft command, using the two-link arm system 35, 36 as described above.

The support 54' receives two claw shafts 54. The claw shafts extend parallel to each other along a horizontal axis and are offset with respect to one another along the normal horizontal axis. The claw shafts are rotatably mounted on the base 42.

The base 42 comprises 2 pairs of bending claws 45*a*, 45*b* and 46*a*, 46*b* (one pair for each pre-clamp, one claw of a given pair for each pre-clamp end) which are fixed on a respective claw shaft 54*a*, 54*b*.

A spring 47 extends between the upper ends of two associated claws, and biases the claws of a given pair toward a rest position. Alternatively, a torsion spring could be mounted directly on each claw shaft end. The claw shaft 54 cooperates by caming action with the surface 49 of the cam bracket 48 to cause rotation of the claws which surround the guard and pass beneath it so as to fold/bend the pre-clamp ends to their final bent condition. This is described for the front claws, but applies equally to the rear claws.

Figure 11:
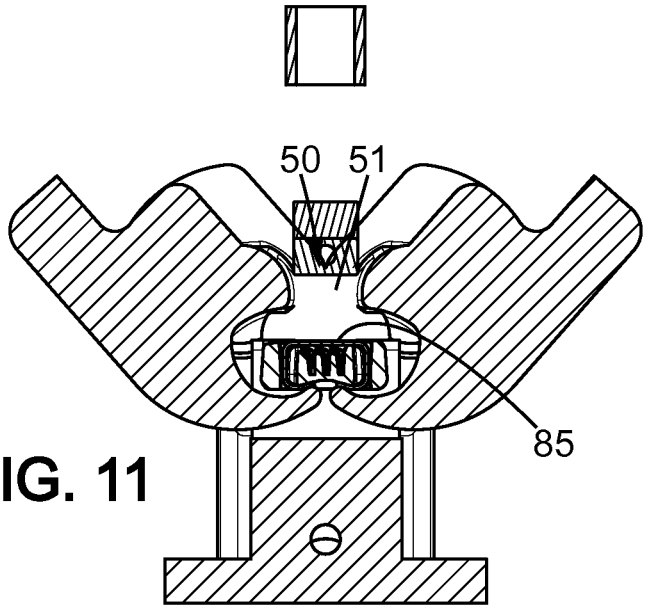
FIG. 11 is a view similar to FIG. 10 at a second step of the clamping process.

In this final condition, and as shown on FIG. 11, the clamp has normally a shape with an end 43 slanted toward the base of the U. The shape of the guard defines this final shape.

The tool further comprises a holder 50 to maintain the clamp and the guard (the holder 50 contacts only the upper clamp surface 85) during the bending action. The holder has a basis 51 mounted to translate on the base 42 of the tool along the Z axis, and a stop 53. Springs 52 are provided between the holder and the base 42.

The station which has just been described operates as follows: The whole cycle is driven by the crankshaft 15 through the arms 35 and 36.

Upon a first step of the movement of the base 42, the basis 51 is moved together with the base 42 until it contacts the upper surface 85 of the pre-clamp and also the stop 53 abuts on a not-shown stop of the frame. This stop of the frame ensures that the holder 50 will stop on its way down in case the nest is empty—without razor head—and so it will not crash on the nest. At this location, the basis 51 forms a load member in contact with the base 81 of the pre-clamp, preventing the pre-clamp from moving upward during bending movement. The stop 53 defines the ultimate exposure of the blades. The stop's position can be finely adjustable in the Z direction by an operator. Hence, the springs which receive the cutting member might be biased to a requested load at this stage.

Further movement downward of the base (second step of base movement) will compress the springs 52 in order to provide a retardation effect upon release and also to allow for the further movement of the base downwards.

As the support moves downward, the claw shafts 54 cooperate with the cam bracket 48, so that the cam surface 49 causes a rotation of the claw shaft with respect to its longitudinal axis. The rear claw shaft is submitted to a movement symmetric to the above one, with respect to a central plane of symmetry passing vertically between the two axis. Thus, the claws 45*a* and 46*a* are rotated counter clock-wise on FIG. 9, and the claws 45*b* and 46*b* clockwise, thereby stretching the springs 47. FIG. 11 thus shows a final stage of the bending, where the clamps are rotated into their final position.

As a third step of the base movement, the claw shafts are rotated in the reverse direction (still by cam action). Upon release, the springs 52 will first be unloaded, without the basis 51 moving upward, thus still somehow maintaining the clamps in place just after bending. Only when the springs are sufficiently uncompressed, the basis 51 will move upwards.

The apparatus can then be provided with an inspection station. This station can for example be an optical inspection station which will check the presence of the two clamps. If the two clamps are not present, the head will be removed from the nest, and will fall to scrap. If the inspection station does not reveal any problem, the operation continues as follows.

The machine 8 further comprises an output station 7 which outputs assembled heads to bulk or toward further processing.

The output station has an actuating means to move the jaws 19 of the nest away from the head against the springing action. The head can be picked-and-placed from the main apparatus to further processing or bulk using a similar pick-and-place apparatus as the one used for pick-and-placing the guard in the nest at the guard-placing station.

Although an embodiment of such an apparatus has been described in details below, other embodiments appear possible.

As a variant of the platen embodiment, the servo-motor 10 could drive stepwise an endless belt consisting of many stages 12 along an assembly path 13 (here a straight path along a longitudinal horizontal axis) and back along a return path parallel to and below the assembly path. In such case, the mis-assembled head will not be removed from the nest, but will fall to scrap when the belt returns to its original position. An inspection station can be provided just before the guard-feeding station to check that the nest really is empty.

Such a system would provide increased modularity, for example in order to add more stations, for example more cutting member insertion stations in order to assemble razor heads with more cutting members. It might just be sufficient to add a few additional stages to cope with the increased length of the path.

The invention claimed is:

1. A method for the manufacture of assemblies, wherein the method comprises:

providing a sub-assembly comprising:

a molded plastic housing having a front part and a rear part, a first lateral part and a second lateral part, the front, rear, first and second lateral parts defining a hollow space between, the molded plastic housing having a top face having a window opening into the hollow space, and an opposed bottom face, the molded plastic housing further comprising elastic support members extending in the hollow space, and at least one through hole inside each one of the first and second lateral parts, the at least one through hole extending from the top face to the bottom face, the at least one through hole provided on one side of the hollow space;

at least one member elastically supported in the molded plastic housing by at least one elastic support member, the at least one member having an elongated edge running from the first to the second lateral parts, wherein the at least one member is accessible through the window, providing at least one pre-clamp, made of a formable material, and having a U-shape with a first and a second parallel leg portions joined by a transverse base portion, assembling the at least one pre-clamp to the sub-assembly, by placing the first and second leg portions on either side of the hollow space with the transverse base portion extending across the elongated edge of the at least one member, and by inserting the first leg portion of the at least one pre-clamp in the at least one through hole;

maintaining the transverse base portion at a settable pre-defined position with respect to the molded plastic housing with a holder, the holder including a basis portion and a stop portion placing the basis portion of the holder in contact with an upper surface of the transverse base portion, the stop portion extending from the basis portion such that movement of the holder is limited; and deforming the first and second leg portions of the at least one pre-clamp to cooperate with the bottom face of the molded plastic housing to hold the at least one member in the molded plastic housing.

2. The method according to claim 1, wherein the housing further comprises at least a second through hole, parallel to the at least one through hole and extending from the top face to the bottom of the molded plastic housing, the second through hole being provided on a side of the hollow space opposite to the at least one through hole, and the method further comprises assembling the at least one pre-clamp to the sub-assembly which comprises inserting the second leg portion of the at least one pre-clamp in the second through hole.

3. The method according to claim 1, further comprising maintaining the at least one pre-clamp with the sub-assembly at least during deforming of the first and second leg portions.

4. The method according to claim 1, further comprising maintaining the at least one pre-clamp with the sub-assembly at least after deforming of the first and second leg portions.

5. The method according to claim 1, wherein providing the sub-assembly comprises:

providing the molded plastic housing, providing the at least one member in the housing.

6. The method according to claim 5, wherein providing the sub-assembly further comprises providing at least a second member elastically supported by at least one elastic support member, the second member having an elongated edge running from the first to the second lateral parts, in parallel with the elongated edge of the at least one member, and wherein the second member is accessible through the window.

7. The method according to claim 1, further including a second pre-clamp, the method further comprising:

providing the second pre-clamp, made of a formable material, and having a U-shape with a first and a second parallel leg portions joined by a transverse base portion, assembling the second pre-clamp to the sub-assembly, in parallel with the at least one pre-clamp, by placing the first and second leg portions of the second pre-clamp on either side of the hollow space, with the transverse base portion of the second pre-clamp extending across the edge of the at least one member, deforming the first and second leg portions of the second pre-clamp to cooperate with the rear face molded plastic of the housing to hold the at least one member in the molded plastic housing.

8. The method according to claim 7, wherein deforming the leg portions of the first and second pre-clamps are performed simultaneously.

9. The method according to claim 1, wherein providing a sub-assembly further comprises holding the housing in a nest, and wherein the method further comprises moving the nest through a plurality of processing stations where respective steps of the method are carried out.

10. The method according to claim 9, further comprising removing an assembled razor head from the nest after deforming the first and second leg portions.

* * * * *